US008359873B2

(12) United States Patent
Lifson et al.

(10) Patent No.: US 8,359,873 B2
(45) Date of Patent: Jan. 29, 2013

(54) OIL RETURN IN REFRIGERANT SYSTEM

(75) Inventors: Alexander Lifson, Manlius, NY (US); Michael F. Taras, Fayetteville, NY (US)

(73) Assignee: Carrier Corporation, Farmington, CT (US)

( * ) Notice: Subject to any disclaimer, the term of this patent is extended or adjusted under 35 U.S.C. 154(b) by 1013 days.

(21) Appl. No.: 12/377,144

(22) PCT Filed: Aug. 22, 2006

(86) PCT No.: PCT/US2006/032836
§ 371 (c)(1),
(2), (4) Date: Feb. 11, 2009

(87) PCT Pub. No.: WO2008/024110
PCT Pub. Date: Feb. 28, 2008

(65) Prior Publication Data

US 2010/0175396 A1 Jul. 15, 2010

(51) Int. Cl.
*F25B 43/02* (2006.01)

(52) U.S. Cl. ..... 62/84; 62/468

(58) Field of Classification Search ..... 62/84, 115, 62/202, 217, 224, 225, 157, 498
See application file for complete search history.

(56) References Cited

U.S. PATENT DOCUMENTS

| | | | | | |
|---|---|---|---|---|---|
| 1,921,163 | A | | 8/1933 | Kenney at al. | |
| 4,459,819 | A | | 7/1984 | Hargraves | |
| 4,467,613 | A | | 8/1984 | Behr et al. | |
| 4,879,879 | A | * | 11/1989 | Marsala et al. | 62/202 |
| 4,907,417 | A | * | 3/1990 | Forsythe | 62/199 |
| 5,163,301 | A | * | 11/1992 | Cahill-O'Brien et al. | 62/217 |
| 5,195,331 | A | * | 3/1993 | Zimmern et al. | 62/202 |
| 5,311,748 | A | * | 5/1994 | Bahel et al. | 62/160 |
| 5,392,612 | A | * | 2/1995 | Alsenz | 62/115 |
| 5,966,950 | A | * | 10/1999 | Schmidt et al. | 62/115 |
| 6,012,299 | A | * | 1/2000 | Schmidt et al. | 62/202 |
| 6,058,729 | A | * | 5/2000 | Lifson et al. | 62/217 |
| 6,357,240 | B1 | | 3/2002 | Zugibe et al. | |
| 6,357,241 | B1 | * | 3/2002 | Dudley | 62/126 |
| 6,467,284 | B1 | * | 10/2002 | Chen et al. | 62/156 |
| 2002/0162344 | A1 | * | 11/2002 | Reason et al. | 62/217 |
| 2004/0194498 | A1 | * | 10/2004 | Burchill et al. | 62/513 |

FOREIGN PATENT DOCUMENTS

| | | |
|---|---|---|
| JP | 56002801 | 1/1981 |

OTHER PUBLICATIONS

International Search Report and Written Opinion mailed Apr. 20, 2007 (7 pgs).

* cited by examiner

*Primary Examiner* — Mohammad Ali
(74) *Attorney, Agent, or Firm* — Cantor Colburn LLP

(57) ABSTRACT

To address the problem of lubricant entrainment within the refrigerant system components such as an evaporator and suction line, a control is provided to periodically, substantially and intermittently increase the refrigerant flow through these components to thereby carry the trapped lubricant back to the compressor. The increased flow of refrigerant can be accomplished by periodically throttling and then unthrottling either an expansion device or a suction modulation valve to cause instantaneous pressure buildup within a respective section of the vapor compression system and subsequent increase of the refrigerant flow through the above-referenced components such as an evaporator and suction line. Suggested time intervals of both the throttling and unthrottling states are provided, as well as the frequency of occurrence for subsequent oil return cycles.

33 Claims, 3 Drawing Sheets

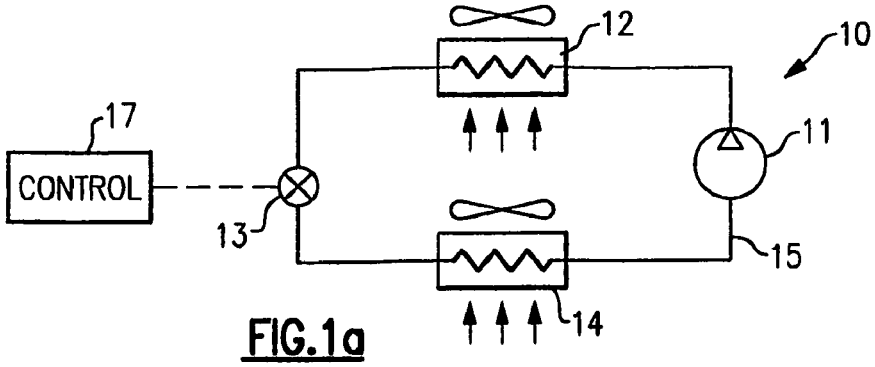
FIG.1a
FIG.1b
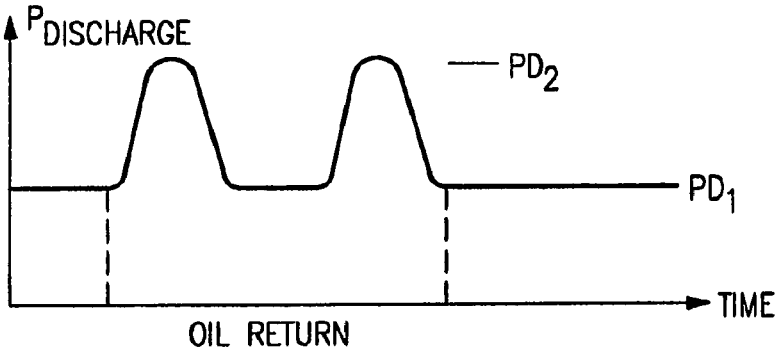
FIG.2a
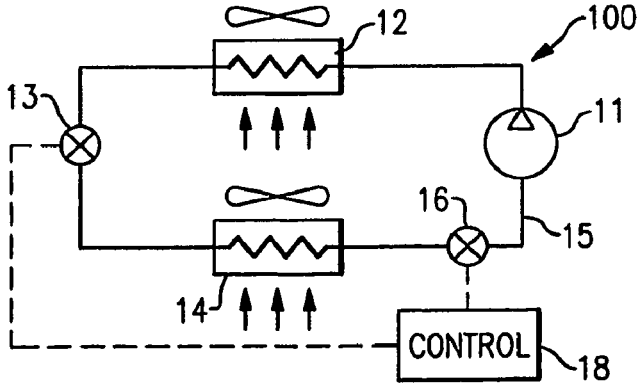
FIG.2b
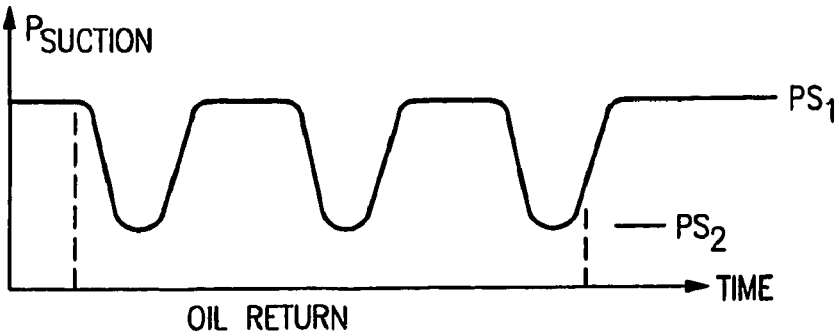

OIL RETURN IN REFRIGERANT SYSTEM

BACKGROUND OF THE INVENTION

This invention relates generally to air conditioning and refrigeration systems and, more particularly, to a method of oil return to a refrigerant compressor to ensure adequate lubrication of the compressor components and with minimal or no performance degradation of a refrigerant system.

In a vapor compression system such as that used in air conditioners, heat pumps and refrigeration units, refrigerant vapor from an evaporator is drawn in by a compressor, which then delivers the compressed refrigerant to a condenser (or a gas cooler for transcritical applications). In the condenser, heat is exchanged between a secondary fluid such as air or water and the refrigerant, and from the condenser, the refrigerant, typically in a liquid state, passes to an expansion device, where the refrigerant is expanded to a lower pressure and temperature, and then passes to the evaporator. In the air conditioning applications, in the evaporator, heat is exchanged between the refrigerant and another secondary fluid such the indoor air or water to condition the indoor air or to cool water.

Since the refrigerant compressor necessarily involves moving parts, it is typically required to provide lubrication to these parts by means of lubricating oil that is mixed with or entrained in the refrigerant passing through the compressor. Although the lubricant is normally not useful within the system other than in the compressor, its presence in the system does not generally detract from the flow and change of state as the refrigerant passes through the system in a conventional vapor compression cycle. However, there is a tendency for oil to be retained within the evaporator or suction line of the refrigerant system. This is particularly true in a system wherein the evaporator is of a microchannel heat exchanger type and when refrigerant mass flow rates are low. If the oil retention in the evaporator becomes excessive, then the performance of the evaporator, as well as that of the entire system, is degraded due to heat transfer reduction and pressure drop increase. More importantly, the oil retention in the evaporator or suction line may reduce the amount of lubricant passing through the compressor such that it is not adequately lubricated, and damage may occur to the compressor components. In the most severe scenario, all oil can be pumped out of the compressor, leaving the compressor internal elements essentially with no lubrication and leading to quick seizure of the compressor.

One approach to solving this problem is that of providing an oil separator downstream of the compressor such that the oil is removed from the refrigerant prior to passing through the remaining sections of the system. However, an oil separator represents an added expense that is not desirable. Further, oil separators are never 100% efficient, so sooner or later a significant amount of oil may be trapped in the refrigerant system components (other than a compressor) causing abovementioned problems. Oil separators can malfunction (plug up, spring a leak, etc.), would often introduce additional undesirable pressure losses and have an inherent high-to-low pressure refrigerant leak since the oil needs to be returned from a high pressure discharge section back to a low pressure side (normally, a compressor oil sump). Therefore, there is a need for a cost effective method to assure oil return to the compressor that preferably doesn't require any extra components added to a refrigerant system.

SUMMARY OF THE INVENTION

Briefly, in accordance with one aspect of the invention, the amount of refrigerant flowing through the evaporator is periodically, suddenly and substantially increased such that the higher mass flow of refrigerant will carry the oil trapped in the evaporator and suction line back to the compressor.

By yet another aspect of the invention, the increase in refrigerant flow through the evaporator can be accomplished by throttling/unthrottling the expansion device to provide a blast of high pressure refrigerant through the evaporator.

By yet another aspect of the invention, the increase in refrigerant flow through the evaporator can be accomplished by throttling/unthrottling the suction modulation valve between the evaporator and the compressor to provide a blast of refrigerant through the evaporator.

In the drawings as hereinafter described, a preferred embodiment is depicted; however, various other modifications and alternate constructions can be made thereto without departing from the spirit and scope of the invention.

BRIEF DESCRIPTION OF THE DRAWINGS

FIG. 1*a* is a refrigerant system with a control that operates in accordance with the present invention.

FIG. 1*b* is a graphic illustration of the compressor discharge pressure as a function of time in accordance with the present invention.

FIG. 2*a* is a schematic illustration of an alternative embodiment of the invention.

FIG. 2*b* is a graphic illustration of the compressor suction pressure as a function of time in accordance with the alternative embodiment of the invention.

DESCRIPTION OF THE PREFERRED EMBODIMENT

Figure 2C:
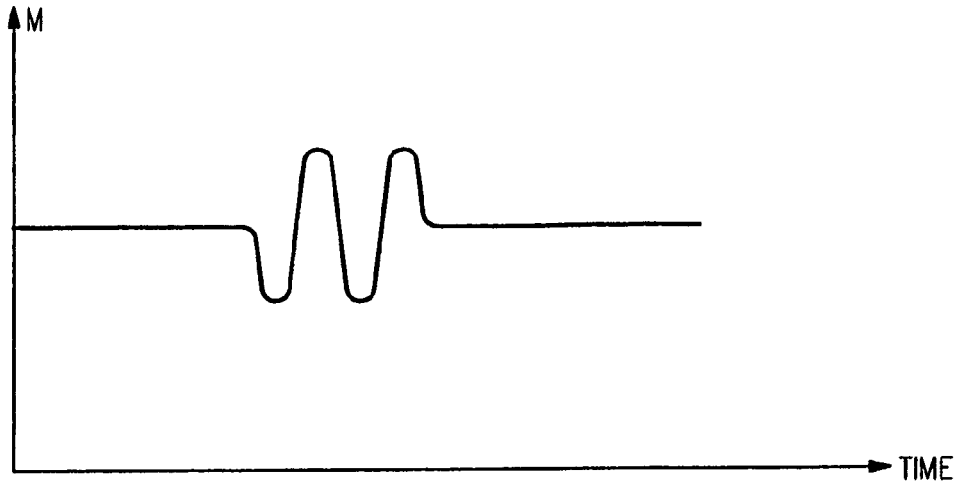
FIG. 2*c* is a graphic illustration of the refrigerant mass flow rate through the evaporator when at least one of the devices (the electronic expansion device or the suction modulation valve) is throttled/unthrottled.

The present invention is intended for use in a vapor compression system 10, which includes in serial flow relationship a compressor 11, a condenser 12, an expansion device 13 and an evaporator 14. The compressor 11, which requires a certain amount of lubricant to properly lubricate its internal moving components, compresses the refrigerant vapor having lubricant entrained therein and passes it on to the condenser 12 where the refrigerant is condensed to a liquid. The liquid refrigerant and lubricant mixture passes to the expansion device 13, where some of the liquid refrigerant flashes to a vapor, and a two-phase refrigerant mixture then passes, along with the liquid lubricant, to the evaporator 14 from which it is returned to the compressor 11 to complete the cycle. It has to be noted that although a very basic refrigerant system configuration is described above, many additional options and features are feasible, and the corresponding refrigerant system schematics will be within the scope of the invention.

Although oil can be trapped in various locations within the refrigerant system 10, the evaporator 14 typically has a higher tendency to entrain a certain amount of lubricant within its volume. This is particular true in the case where an evaporator construction is of a microchannel heat exchanger type, which has a plurality of small passages within each heat transfer tube, and at low refrigerant flows, which are typical for part-load conditions or low temperature refrigeration applications. Additionally, increased oil viscosity at low temperatures, as well as potential miscibility and solubility issues, aggravate the problem in hand. If the accumulation of lubricant in the evaporator 14 becomes excessive, there will not be a sufficient amount of lubricant getting back to the compressor 11, and the compressor component frictional overheating results in nuisance shutdowns and/or subsequent permanent damage to the compressor. Also, with the accumulation of lubricant in the evaporator 14, the refrigerant in-tube thermal and hydraulic resistances will increase negatively affecting the evaporator and entire system performance. Furthermore, in certain types of compressors, such as scrolls and screws, oil is relied upon to seal the gaps between the compression elements to prevent refrigerant leakage from high to low pressure compression chambers. Therefore, an insufficient amount of oil will reduce compressor volumetric and isentropic efficiencies and the amount of refrigerant delivered throughout the refrigerant system 10.

The expansion device 13 is an electronically controlled expansion valve with a variable orifice for selectively varying the amount of refrigerant that is allowed to pass therethrough and to the evaporator 14 as a vapor and liquid mixture. Typically, the expansion valve 13 is activated and controlled by a stepper motor (not shown) utilizing sensor feedback of the evaporator superheat to a system control 17. Such sensors can be temperature and/or pressure transducers. These sensors are typically positioned at the suction line locations between the evaporator 14 and compressor 11 (usually at the evaporator outlet) and provide measurements of the evaporator superheat to the system controller 17. This allows the valve to be operated in the manner so as to maintain a consistent superheat at the evaporator outlet, regardless of thermal load and environmental conditions. For purposes of the present invention the control 17 is provided so as to modify the normal operation of the expansion valve 13 in a manner to be described. The control 17 can be a refrigerant system control or a separate valve control.

In order to solve the problem of oil retention in the evaporator as discussed hereinabove, the control 17 operates to intermittently, and preferably in a pulsing manner, substantially increase the refrigerant flow through the evaporator 14 by throttling/unthrottling the expansion device 13. That is when the expansion device 13 is periodically throttled, pressure is built up in the condenser 12 and pressure is reduced in the evaporator 11. When the expansion device 13 is then unthrottled or opened, a blast of high pressure refrigerant is forced to pass through the expansion device 13 and the evaporator 14. The short blast of refrigerant will tend to carry the oil that has been trapped in the evaporator 14 and suction line 15 back to the compressor 11. Such intermittent blasts of refrigerant will help to return oil that was trapped in evaporator 11 and suction line 15 and avoid potential reliability and performance degradation issues.

Referring now to FIG. 1*b*, it may be seen that during normal operating conditions, the discharge pressure at the compressor 11 is at a constant level as shown at $PD_1$. However, when the control 17 operates the expansion valve 13 in the manner described hereinabove to provide a short blast (or a series of short blasts) of refrigerant, the discharge pressure at the compressor 11 is substantially and intermittently increased to a level of $PD_2$ as indicated by the two peaks in FIG. 1*b*. It should be noted that the suction pressure at the evaporator and compressor will be decreasing in unison with the discharge pressure rise, since most of the refrigerant will be intermittently pumped out to a high pressure side. Also, since the oil return operational sequence is executed relatively fast, refrigerant system thermal inertia provides sufficient cushion so that the refrigerant system performance is not affected.

Referring now to FIG. 2*a*, an alternative embodiment 100 of the present invention is shown to include a control 18 for controlling the suction modulation valve 16 in a similar manner as described hereinabove. The suction modulation valve is positioned on the suction line 15 and is typically utilized to provide part-load operation of a refrigerant system. The suction modulation valve 16 may be utilized for oil return separately or in conjunction with the expansion valve 13. Furthermore, the individual use of the suction modulation valve 16 may take place when an expansion device is not electronically controlled. In the latter case, the expansion device can be, for example, a TXV type or a fixed restriction type.

In full-load operation, the suction modulation valve 16 is fully open and doesn't appreciably affect refrigerant flow entering the compressor 11 and overall operation of the refrigerant system 100. When the thermal load on the refrigerant system 100 decreases, the suction modulation valve 16, typically controlled by a stepper motor (not shown), gradually closes, reducing the refrigerant amount delivered to the compressor 11, until delivered system capacity balances thermal load demands. This control strategy matches the compressor capacity to the thermal load demands and prevents operation with undesirably low evaporator temperatures leading to frost formation conditions.

For purposes of the present invention, the control 18 is used to intermittently increase the refrigerant flow through the evaporator 14 in a manner similar as described hereinabove. That is, by periodically throttling the suction modulation valve 16, pressure is built up in the evaporator 14. When the suction modulation valve 16 is then unthrottled or opened, a short blast of refrigerant will then pass through the evaporator 14 and will carry the oil that has been trapped in the evaporator 14 back to the compressor 11. Once again, such intermittent blasts of refrigerant will help to return refrigerant that was trapped in the suction line 15 as well.

As the control 18 controls the operation of the suction modulation valve 16 as described hereinabove, the suction pressure at the compressor 11 is substantially and intermittently changed from the normal operating pressure as shown $PS_1$ to the lower pressure $PS_2$ as shown by the three valleys in FIG. 2*b*. At the same time, the pressure in the evaporator 14 will be building up, since most of the refrigerant will be intermittently pumped into the evaporator. Once again, since the oil return operational sequence is executed relatively fast, refrigerant system thermal inertia provides sufficient cushion so that system performance is not affected.

Further, the electronically controlled expansion valve 13 and the suction modulation valve 16 can be operated in conjunction with each other. For instance, when the expansion valve 13 is intermittently closed, the suction modulation valve 16 is simultaneously opened, so that most of the refrigerant is collected on a high pressure side of the refrigerant system in preparation to the next blast for oil return to the compressor 11. Alternatively, when the expansion valve 13 is intermittently opened, the suction modulation valve 16 is simultaneously closed, so that most of the refrigerant is accumulated in the evaporator 14 before the next oil return blast.

In another method, at the operating conditions where oil retention might be a problem, the amount of refrigerant mass flow circulating through the system can be increased by opening the suction modulation valve 16 substantially wider, on an intermittent basis, than is required by thermal load demands at these operating conditions. If the suction modulation valve 16 were opened wider; that would result in the increased refrigerant mass flow passing through the evaporator 14 and suction line 15. As known, it is easier to return oil to the compressor 11 when the mass flow rate and refrigerant velocity throughout the refrigerant system are increased.

Analogously, the electronic expansion valve 13 may be opened substantially wider than required by the thermal load demands in the conditioned environment, for a relatively short period of time, to allow higher refrigerant flow rates through the system and thus providing better oil return to the compressor 11. As known, these conditions may cause temporal flooding of the compressor 11. Although compressor flooding is an undesired phenomenon in general, it may help in returning oil to the compressor 11, since most of the oil is trapped in the superheating section of the evaporator 14 and in the suction line 15. Therefore, the liquid refrigerant will be dissolved in oil, reducing its viscosity. Furthermore, the liquid refrigerant will mix with diluted lower viscosity oil and wash it off the internal surfaces bringing the oil back to the suction port of the compressor 11. It should be pointed out that the latter technique could be employed only for the compressors that can withstand temporal flooding conditions, such as scroll and screw compressor types. Also, if the refrigerant system incorporates both the electronic expansion valve 13 and the suction modulation valve 16, then it is feasible and beneficial to widely open both of these flow control devices for a short period of time to substantially increase refrigerant flow rate and promote oil return to the compressor 11.

Figure 2D:
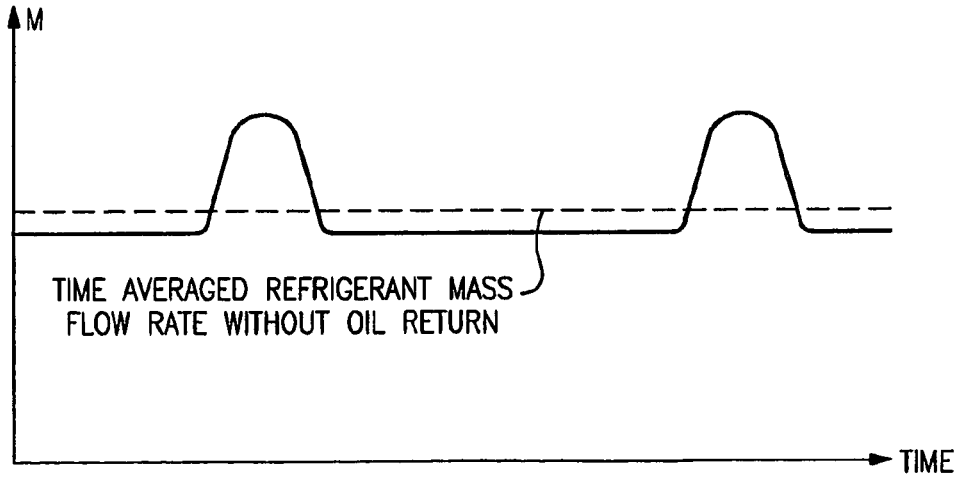
FIG. 2*d* is a graphic illustration of the refrigerant mass flow rate through the evaporator when at least one of the electronic expansion device or suction modulation valve is widely opened for a relatively short period of time.

Shown in FIG. 2*c* is a graphic representation of the refrigerant mass flow rate M through the evaporator when at least one flow control device (the electronically controlled expansion valve 13 or the suction modulation valve 16) is throttled/unthrottled in a manner as described hereinabove. When the respective flow control device is throttled, the refrigerant mass flow is appreciably decreased from the normal operation level (as represented by the horizontal line). On the other hand, when the respective flow control device is unthrottled, the refrigerant mass flow is substantially increased above the normal operation level, and then upon the throttling it is then again reduced to below the normal operation level, as shown. As also shown, the throttling/unthrottling process can be repeated several times, if desired FIG. 2*d* shows the change in the refrigerant mass flow rate M through the evaporator when either the suction modulation valve 16 or the electronic expansion valve 13 (or both of them) is opened widely for a short period of time, as described hereinabove. The dashed line in FIG. 2*d* represents a time averaged refrigerant mass flow rate that must be maintained in order to meet the thermal load demands, or in other words, the refrigerant mass flow rate that would be circulating through the refrigerant system without the implementation of the oil return method. The two crests represent the times in which the flow control device is widely opened (e.g. on the order of 30 seconds). It should be noted, that the time period over which the respective flow control device remains widely open, as shown in FIG. 2*d*, could be potentially longer then the throttling time interval shown in FIG. 2*c*, since in the latter case it is more restricted by the reliability concerns. The horizontal line below the dashed line represents the slightly reduced refrigerant mass flow rate at times when the respective flow control device is later moved toward the normal operating position. In this regard, it should be recognized that this mass flow rate is slightly below a normal value required by the thermal load demand, in order to obtain the desired time averaged mass flow rate as represented by the dashed line.

It should be recognized that in the normal course of operation (i.e. aside from the present invention), both the expansion valve 13 and the suction modulation valve 16 includes some form of control to selectively vary the degree in which the valves are opened. In order to carry out the present invention, one must simply provide further control so as to cause one or the other of the two devices (or both of them) to operate in the manner as described hereinabove. Since all the control is provided by the software logic modification, no additional hardware is required in order to implement the present invention.

Figure 3:
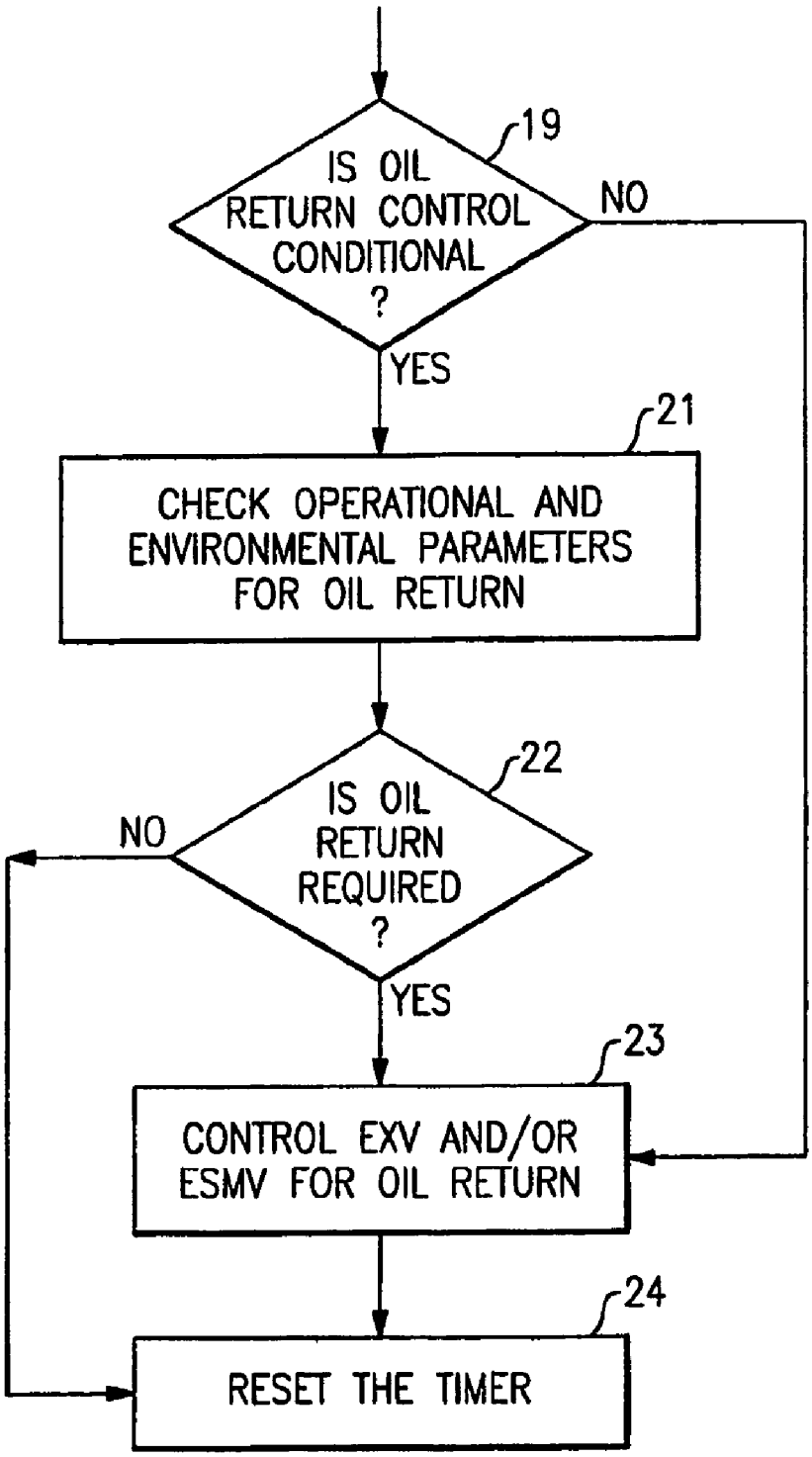
FIG. 3 is a flow chart illustrating a method in accordance with one embodiment of the present invention.

Referring now to FIG. 3, the exemplary process by which the control 17 or 18 performs its function is shown. In a block 19, the decision is made by the control as to whether the oil return function is dependent on certain operational and environmental parameters, or whether there is no provision for sensing these parameters. If the system is of the type in which these parameters cannot be sensed, then the control is transferred to a block 23 and proceeds from there.

If the system does include provisions for sensing various parameters, which would indicate that potential conditions existed wherein sufficient amount of oil would not be returned to the compressor, then the control proceeds to a block 21 to sense those parameters and determine whether the process of the present invention is required in order to ensure oil return to the compressor as shown in a block 22. Such sensed parameters may include (but are not limited to) the compressor suction pressure $P_S$, the saturation suction temperature $T_{SS}$, the compressor suction temperature $T_S$, the compressor discharge pressure $P_D$, the compressor saturation discharge temperature $T_{SD}$, the compressor discharge temperature $T_D$, the ambient temperature $T_{AMB}$, the indoor temperature $T_{INDOOR}$, the compressor current $I_C$, the compressor power draw $W_C$, etc. These parameters may be used separately or in conjunction with each other. For instance, if the suction pressure $P_S$ is below a predetermined threshold, the determination can be made that the refrigerant mass flow is unacceptably low that may lead to oil retention conditions in the evaporator or in the suction line and potential compressor reliability problems. Analogously, a combination of the compressor suction $T_S$ and discharge temperatures $T_D$ may lead to similar conclusions. These parameter combinations are purely exemplary, and many other cases can be constructed as well.

If the sensed parameters indicate that there is no problem with oil return to the compressor, then the controller proceeds to a block 24 such that the timer is reset for a later execution of the control logic.

If the sensed parameters indicate that an oil return process is required, then the process moves to the block 23 wherein the expansion valve 13 or the suction modulation valve 16 (or a combination of both) is throttled/unthrottled in the manner as described hereinabove. In this regard, it should be recognized that the timing for each of the throttling and unthrottling steps, as well as the number of times in which the cycle is repeated, may vary depending on the operational conditions and the type of the refrigerant system. As a general guideline, the valve could be closed for a period of 1-5 seconds and opened for a period 10-30 seconds, with the cycle being repeated from 1-10 times in succession. Alternatively, a method of wide opening of the respective flow control device can be executed, where the flow control device typically needs to be cycled only once.

It should also be recognized that either of the EXV or ESM valves do not need to be fully closed or fully opened in the throttling/unthrottling step but may be moved to some intermediate position that would provide the desired result of returning the trapped oil without substantially deviating from the normal course of operation.

After the oil return process is completed, the timer is reset in the block 24, such that after a preselected period of time, which may again be substantially varied to suit the particular system and application, the control returns to the block 19 to repeat the process. A suggested time between these successive oil return processes is 2-5 hours.

It should be noted that if there are other flow control devices present in the refrigerant system they can be used in a similar manner, individually or in conjunction with other valves, as described above, to achieve similar pressure buildup and intermittent refrigerant blast conditions to assist in oil return to the compressor when required.

We claim:

1. A method of operating a refrigerant system having a compressor, a condenser, an expansion device, an evaporator and a suction modulation valve, comprising the steps of:

operating the system in a normal conventional mode of operation to provide refrigerant flow through the evaporator at a normal rate determined by a thermal demand on the refrigerant system; and periodically, substantially and intermittently increasing the flow of refrigerant through the evaporator such that the flow rate exceeds the normal flow rate to thereby flush out lubricant that has been entrained in the evaporator or suction line wherein said step of increasing the refrigerant flow is accomplished by first throttling one of the expansion device and the suction modulation valve and unthrottling the other of the expansion device and the suction modulation valve to temporarily build up pressure in the condenser and then unthrottling the throttled one of the expansion device and the suction modulation valve to provide a blast of refrigerant through the evaporator.

2. The method as set forth in claim 1 wherein said step of increasing the refrigerant flow is accomplished by first throttling the suction modulation valve and unthrottling the expansion device to build up pressure in the evaporator and then unthrottling the suction modulation valve to cause a blast of refrigerant through the evaporator.

3. The method as set forth in claim 1 wherein said step of increasing the refrigerant flow is accomplished by first throttling the expansion device and unthrottling the suction modulation valve to build up pressure in the condenser and then unthrottling the expansion device to cause a blast of refrigerant through the evaporator.

4. The method as set forth in claim 3 wherein the throttling position of the expansion device corresponds to a fully closed position.

5. The method as set forth in claim 3 wherein the unthrottling position of the expansion device corresponds to a fully open position.

6. The method as set forth in claim 2 wherein the throttling position of the suction modulation valve corresponds to a fully closed position.

7. The method as set forth in claim 2 wherein the unthrottling position of the suction modulation valve corresponds to a fully open position.

8. The method as set forth in claim 1 wherein initiation of an oil return cycle is determined based on a timer setting.

9. The method as set forth in claim 1 wherein initiation of an oil return cycle is determined based on refrigerant system operational and environmental parameters.

10. The method as set forth in claim 9 wherein said operational and environmental parameters are selected from the group consisting of a compressor suction pressure, saturation suction temperature, compressor suction temperature, compressor discharge pressure, compressor saturation discharge temperature, compressor discharge temperature, ambient temperature, indoor temperature, compressor current, compressor power draw.

11. The method as set forth in claim 3 wherein the expansion device is throttled for a period of 1-5 seconds.

12. The method as set forth in claim 3 wherein the expansion device is unthrottled for a period of 10-30 seconds.

13. The method as set forth in claim 3 wherein said throttling and unthrottling steps of the expansion device are repeated 1-10times in succession.

14. The method as set forth in claim 3 further including the steps of repeating the oil return process every 2-5 hours.

15. The method as set forth in claim 2 wherein the suction modulation valve is throttled for a period of 1-5 seconds.

16. The method as set forth in claim 2 wherein the suction modulation valve is unthrottled for a period of 10-30 seconds.

17. The method as set forth in claim 2 wherein said throttling and unthrottling steps are repeated 1-10 times in succession.

18. The method as set forth in claim 2 and including the steps of repeating the oil return process every 2-5 hours.

19. A vapor compression system, comprising:

a compressor for receiving refrigerant vapor with lubricant entrained therein and compressing the refrigerant vapor;

a condenser for receiving the compressed refrigerant vapor with lubricant entrained therein and condensing at least a portion of the refrigerant vapor;

an expansion device for receiving the condensed refrigerant with lubricant entrained therein and expanding the refrigerant to a lower pressure and temperature;

an evaporator for receiving the refrigerant with the lubricant entrained therein from the expansion device and passing it to the compressor while retaining a portion of the lubricant;

a suction modulation valve disposed in a suction line establishing refrigerant flow communication between the evaporator and the compressor; and a control for causing a periodic, substantial and intermittent increase in the flow of refrigerant through the evaporator to flush out lubricant that has entrained therein, said control operative to provide a blast of refrigerant through the evaporator by first throttling one of the expansion device and the suction modulation valve and unthrottling the other of the expansion device and the suction modulation valve and then unthrottling the throttled one of the expansion device and the suction modulation valve.

20. A method of operating a vapor compression system including a compressor, a condenser, an expansion device and an evaporator, wherein a lubricant is entrained within the refrigerant and the refrigerant and lubricant mixture is circulated throughout the system, comprising the step of:

periodically providing a blast of refrigerant through the evaporator by causing a substantial increase in the refrigerant flow rate through the evaporator to remove lubricant that has entrained therein by first throttling the expansion device to temporarily build up pressure in the condenser and then unthrottling the expansion device.

21. The method as set forth in claim 20 wherein the expansion device is throttled for a period of 1-5 seconds.

22. The method as set forth in claim 20 wherein the expansion device is unthrottled for a period of 10-30 seconds.

23. The method as set forth in claim 20 wherein said throttling and unthrottling steps of the expansion device are repeated 1-10 times in succession.

24. The method as set forth in claim 20 wherein said expansion device is opened for a period of 20-40 seconds.

25. A method of operating a vapor compression system including a compressor, a condenser, an expansion device, an evaporator and a suction modulation valve, wherein a lubricant is entrained within the refrigerant and the refrigerant and lubricant mixture is circulated throughout the system, comprising the step of:

periodically providing a blast of refrigerant through the evaporator by causing a substantial increase in the refrigerant flow rate through the evaporator to remove lubricant that has entrained therein, wherein said step of increasing the refrigerant flow is accomplished by one of first throttling the suction modulation valve to build up pressure in the evaporator and then unthrottling the suction modulation valve and first throttling the expansion device to build up pressure in the condenser and then unthrottling the expansion device.

26. The method as set forth in claim 25 wherein said step of increasing the refrigerant flow is accomplished by first throttling the suction modulation valve and unthrottling the expansion device to build up pressure in the evaporator and then unthrottling the suction modulation valve to cause a blast of refrigerant through the evaporator.

27. The method as set forth in claim 25 wherein said step of increasing the refrigerant flow is accomplished by first throttling the expansion device and unthrottling the suction modulation valve to build up pressure in the condenser and then unthrottling the expansion device to cause a blast of refrigerant through the evaporator.

28. The method as set forth in claim 25 further including the steps of repeating the oil return process every 2-5 hours.

29. The method as set forth in claim 26 wherein the suction modulation valve is throttled for a period of 1-5 seconds.

30. The method as set forth in claim 26 wherein said suction modulation valve is unthrottled for a period of 10-30 seconds.

31. The method as set forth in claim 25 wherein said throttling and unthrottling steps of the suction modulation valve are repeated 1-10 times in succession.

32. The method as set forth in claim 25 further including the steps of repeating the oil return process every 2-5 hours.

33. The method as set forth in claim 25 wherein the suction modulation valve is opened for a period of 20-40 seconds.

* * * * *